US006755347B1

(12) United States Patent
Holz

(10) Patent No.: US 6,755,347 B1
(45) Date of Patent: Jun. 29, 2004

(54) METHOD FOR ADJUSTING THE AMOUNT OF FLOW AT A FUEL INJECTION VALVE

(75) Inventor: Dieter Holz, Affalterbach (DE)

(73) Assignee: Robert Bosch GmbH, Stuttgart (DE)

( * ) Notice: Subject to any disclaimer, the term of this patent is extended or adjusted under 35 U.S.C. 154(b) by 282 days.

(21) Appl. No.: 09/857,334

(22) PCT Filed: Sep. 29, 2000

(86) PCT No.: PCT/DE00/03451

§ 371 (c)(1),
(2), (4) Date: Oct. 1, 2001

(87) PCT Pub. No.: WO01/25620

PCT Pub. Date: Apr. 12, 2001

(30) Foreign Application Priority Data

Oct. 2, 1999 (DE) ..... 199 47 780

(51) Int. Cl.[7] ..... F02D 7/00

(52) U.S. Cl. ..... 239/5; 239/533.12; 239/491; 239/494; 239/584; 239/585.1; 239/590

(58) Field of Search ..... 239/5, 491, 494, 239/496, 497, 533.12, 584, 585.1, 585.4, 585.5, 590, 590.3, 596

(56) References Cited

U.S. PATENT DOCUMENTS 5,570,841 A 11/1996 Pace et al.
6,168,094 B1 * 1/2001 Schatz et al. ..... 239/533.12
6,168,099 B1 * 1/2001 Hopf et al. ..... 239/596
6,170,763 B1 * 1/2001 Fuchs et al. ..... 239/533.12
6,170,764 B1 * 1/2001 Muller et al. ..... 239/533.12
6,173,914 B1 * 1/2001 Hopf et al. ..... 239/583
6,199,776 B1 * 3/2001 Andorfer ..... 239/585.4
6,230,992 B1 * 5/2001 Arndt et al. ..... 239/585.1
6,273,349 B1 * 8/2001 Fischbach et al. ..... 239/585.1

FOREIGN PATENT DOCUMENTS

| | | |
|---|---|---|
| DE | 20 45 596 | 3/1971 |
| DE | 40 25 945 | 2/1992 |
| DE | 197 24 075 | 12/1998 |

* cited by examiner

*Primary Examiner*—Gene Mancene
*Assistant Examiner*—Thach H Bui
(74) *Attorney, Agent, or Firm*—Kenyon & Kenyon

(57) ABSTRACT

A method for adjusting the flow quantity in a fuel injector, that has an excitable actuation element, a valve-closure member that can be moved axially along a valve longitudinal axis, the valve-closure member, for the purpose of opening and closing the valve, cooperating with a fixed valve seat that is configured on a valve seat element, and a multilayer, or multiple-disk, perforated disk that is arranged downstream of the valve seat, is characterized by the fact that, in a first method step, the discharged fuel quantity of the opened fuel injector is measured and, in a second method step, a lower base layer of the perforated disk is deformed in the direction of the valve seat into a vacant flow-cross-section of the layer situated on top of it and, as a result, the vacant flow-cross-section within the perforated disk is changed until the actual quantity discharged corresponds to the predetermined setpoint quantity.

10 Claims, 3 Drawing Sheets

METHOD FOR ADJUSTING THE AMOUNT OF FLOW AT A FUEL INJECTION VALVE

FIELD OF THE INVENTION

The present invention relates to a method for adjusting the flow quantity in a fuel injector.

BACKGROUND INFORMATION

From German Patent No. 40 25 945, a method is already known for adjusting the static fuel quantity that is spray-discharged in the stationary opening state of a fuel injector. In this context, the fuel quantity delivered is first measured when the fuel injector is open. Subsequently, the position of a perforated disk, having at least two metering openings and arranged downstream of the valve seat, is changed, as a result of which the vacant flow-cross-sections of the individual metering openings are varied. This shift in position lasts until the actual quantity discharged coincides with the stipulated setpoint quantity. The perforated disk is subsequently fixed in this position.

In addition, from DT 2 045 596 A1, it is already known to deform at least one swirl channel on a fuel injector. The swirl channel provided on a valve seat body is gradually narrowed in its flow-through cross-section by deformation until the flow quantity in the swirl channel has attained a preestablished setpoint value. The deformation is carried out by a press ram, which is introduced into the nozzle body in the downstream direction. By rotating the press ram, the cross-section of the swirl channel on the valve seat is reduced.

From U.S. Pat. No. 5,570,841, a fuel injector is already known that has a multiple-disk perforated disk. In this context, one disk of this atomization attachment in disk form has a contour for generating a swirl in the fuel to be spray-discharged. The flow, i.e., the flow quantity, of fuel through the perforated disk is set by the cross-sections of the individual swirl channels and cannot be changed.

From German Published Patent Application No. 197 24 075, a method is already known for manufacturing perforated disks for injectors. In this context, it is a question of so-called sheet-metal-laminate perforated disks, in which at least two thin sheet-metal layers are applied one on top of the other. Each sheet-metal layer of a perforated disk of this type has a different opening geometry, the openings being introduced already before the sheet-metal layers are placed on top of each other. Here too, the cross-sections of the openings determine the through-flow of the fuel and cannot subsequently be changed.

SUMMARY OF THE INVENTION

The method according to the present invention for adjusting the flow quantity in a fuel injector has the advantage that it makes it possible, in a simple manner, in a fully assembled fuel injector, to change a multilayer, or multiple-disk, perforated disk in its opening cross-sections, as a result of which the flow quantities to be discharged can be adjusted very simply even in fuel injectors having perforated disks of this type.

It is especially advantageous to execute the perforated disk as a swirl disk, especially as a so-called sheet-metal-laminate swirl disk, at least one central layer of the perforated disk having an opening contour having swirl channels and a swirl chamber. Ideally, the flow quantity is adjusted by the perforated disk, such that the deformation of the lower layer of the perforated disk is carried out in the area of at least one swirl channel, so that material of the base layer is shifted into the vacant flow-cross-section of the at least one swirl channel. Using a plurality of deformation rams for the deformation tool, it is advantageously possible to change the vacant flow-cross-section of a multiplicity of swirl channels simultaneously.

It is particularly advantageous to carry out the flow measurement of the fuel through the perforated disk immediately during the deformation process. In this way, the time used for adjusting the flow quantity is kept to a minimum.

For deforming the lower base layer of the perforated disk, a deformation tool is advantageously used which includes a stationary tool part as the perforated disk receptacle and at least one movable tool part in the form of a deformation ram.

DETAILED DESCRIPTION

Figure 1:
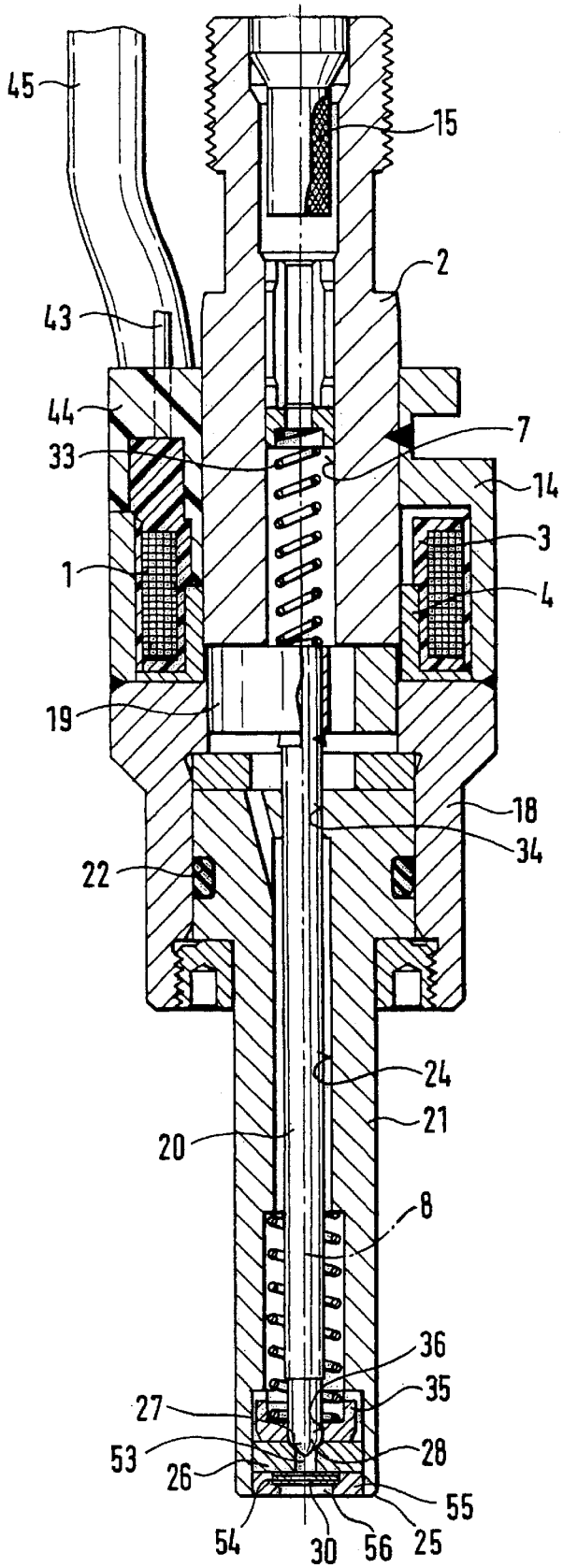
FIG. 1 depicts an exemplary embodiment of a fuel injector having a perforated disk that can be shaped according to the present invention.

The electromagnetically actuatable valve, depicted by way of example in FIG. 1, in the form of an injector for fuel injection systems of mixture-compressing, spark-ignition internal combustion engines, has a tubular, substantially hollow-cylindrical core 2 that is at least partially surrounded by a solenoid coil 1 and that acts as the internal pole of the magnetic circuit. The fuel injector is particularly well suited as a high-pressure injector for directly injecting fuel into a combustion chamber of an internal combustion engine.

A plastic coil shell 3, e.g., having a stepped shape, receives a winding of solenoid coil 1 and, together with core 2 and an annular, nonmagnetic intermediate part 4, which is partially surrounded by solenoid coil 1 and which has an L-shaped cross-section, makes possible a particularly compact and short design of the injector in the area of solenoid coil 1.

In core 2, an open longitudinal opening 7 is provided, which extends along a valve longitudinal axis 8. Core 2 of the magnetic circuit also acts as a fuel intake feed pipe, longitudinal opening 7 representing a fuel supply channel. Fixedly connected to core 2 above solenoid coil 1 is an outer, metallic (e.g., ferritic) housing part 14, which, as the external pole, i.e., external conductive element, closes the magnetic circuit and completely surrounds solenoid coil 1 at least in the circumferential direction. In longitudinal opening 7 of core 2, a fuel filter 15 is provided on the intake side, the filter assuring the filtration of those fuel components which, due to their size, could cause blockage or damage in the injector.

Core 2, together with housing part 14, constitutes the supply-side end of the fuel injector. Connected to upper housing part 14 in a sealing and fixed manner is a lower tubular housing part 18, which, e.g., surrounds and receives an axially movable valve part composed of an armature 19 and a rod-shaped valve needle 20 as well as an elongated valve seat support 21. The seal between housing part 18 and valve seat support 21 is accomplished, e.g., by a sealing ring 22. Valve seat support 21 over its entire axial extension has an internal flow-through opening 24, which runs concentrically with respect to valve longitudinal axis 8.

In its lower end 25, which also represents the downstream termination of the entire fuel injector, valve seat support 21 surrounds a disk-shaped valve seat element 26, fitted in flow-through opening 24 and having a valve seat surface 27 that tapers in the downstream direction forming a truncated cone. In flow-through opening 24, valve needle 20 is arranged, which is, e.g., rod-shaped and which has a substantially circular cross-section, the valve needle at its downstream end having a valve-closure segment 28. This, e.g., conically tapering valve-closure segment 28 cooperates in a familiar manner with valve seat surface 27 provided in valve seat element 26. Downstream of valve seat surface 27, after valve seat element 26, is a perforated disk 30, which includes a plurality of metallic layers, or disks, which are assembled on top of each other. This type of perforated disk 30 can be considered a so-called sheet-metal laminate perforated disk, which can be manufactured, for example, in the manner described in German Published Patent Application No. 197 24 075.

The injector is actuated in a familiar manner, here electromagnetically. Acting to accomplish the axial motion of valve needle 20 and therefore the opening, or closing, of the injector in opposition to the spring force of resetting spring 33, which is arranged in longitudinal opening 7 of core 2, is the electromagnetic circuit composed of solenoid coil 1, core 2, housing parts 14 and 18, and armature 19. Armature 19 is connected, e.g., by a welded seal, to the end of valve needle 20 that is facing away from valve-closure segment 28, and it is aligned with core 2. Acting to guide valve needle 20 during its axial motion together with armature 19 along valve longitudinal axis 8, is, on the one hand, a guide opening 34 provided in valve seat support 21 on the end facing armature 19 and, on the other hand, a disk-shaped guide element 35 having a dimensionally accurate guide opening 36, the guide element being arranged upstream of valve seat element 26.

In place of the electromagnetic circuit, a different excitable actuator, such as a piezo stack, can also be used in a comparable fuel injector, or the actuation of the axially movable valve part can take place using hydraulic pressure or servo pressure.

The stroke of valve needle 20 is predetermined by the installation position of valve seat element 26. When solenoid coil 1 is not excited, the end position of valve needle 20 is determined by the disposition of valve-closure segment 28 on valve seat surface 27 of valve seat element 26, whereas the other end position of valve needle 20, when solenoid coil 1 is excited, is determined by the disposition of armature 19 on the downstream end face of core 2. The surfaces of the components in the aforementioned limit-stop area are, for example, chromium-plated.

The electrical contacting of solenoid coil 1, and therefore its excitation, are carried out by contact elements 43, which are provided with a plastic extrusion coat 44 outside of coil shell 3. Plastic extrusion coat 44 can also extend over further components (e.g., housing parts 14 and 18) of the fuel injector. Emerging from plastic extrusion code 44 is an electrical connecting cable 45, which provides the current for solenoid coil 1. Plastic extrusion code 44 projects through upper housing part 14, which is interrupted in this area.

Downstream of valve seat surface 27, an outlet opening 53 is introduced in valve seat element 26, through which, when the valve is opened, the fuel flows along valve seat surface 27, subsequently entering perforated disk 30, which is specifically executed as a swirl disk. Perforated disk 30 is situated, for example, in a recess 54 of a disk-shaped retaining element 55, retaining element 55 being fixedly joined to valve seat support 21, e.g., by welding, adhesives, or by locking. The mounting variant depicted in FIG. 1 of the perforated disk 30 is represented only in simplified form and shows only one of many various mounting possibilities. In retaining element 55, downstream of recess 54, there is a central outlet opening 56, through which the now swirl-impacted fuel exits the fuel injector. Perforated disk 30 has an external diameter such that it can be fitted tightly, with minimum play, into a receiving opening on the fuel injector, e.g., in recess 54 of retaining element 55 or in an opening of valve seat support 21.

Figure 2:
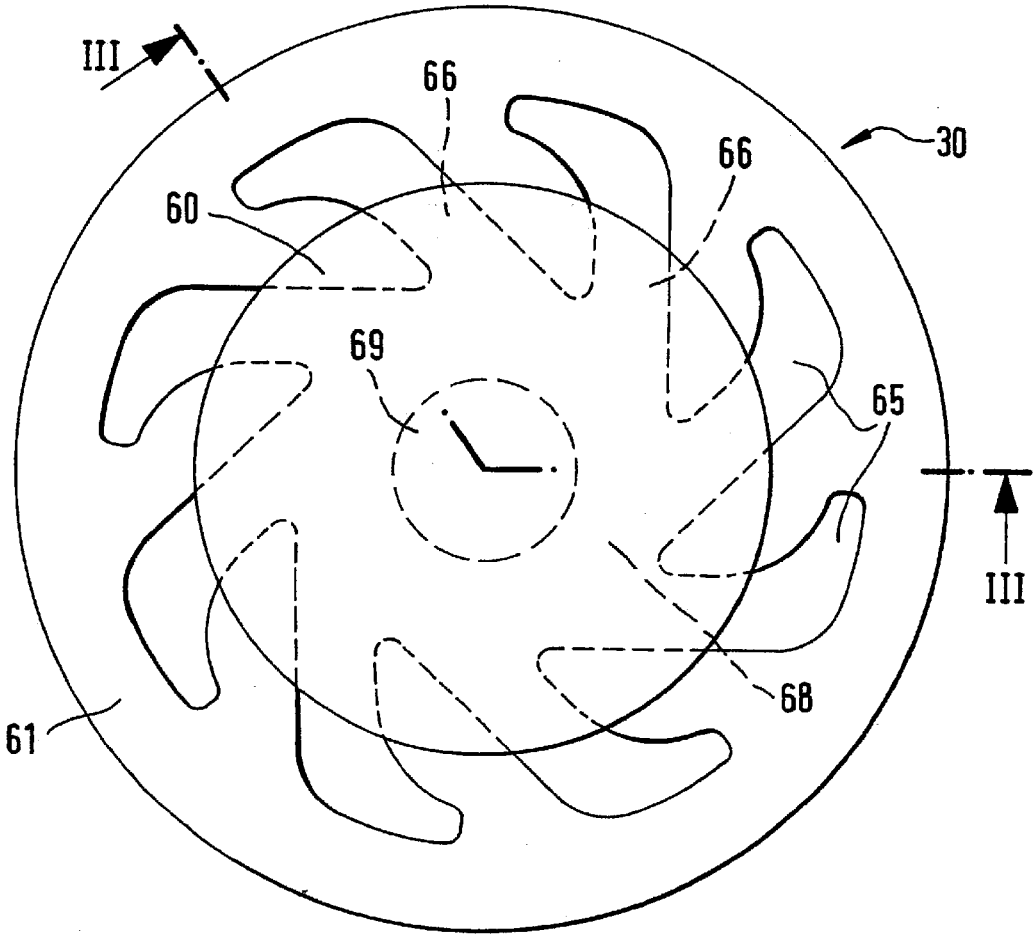
FIG. 2 depicts a perforated disk in a top view.
Figure 3:
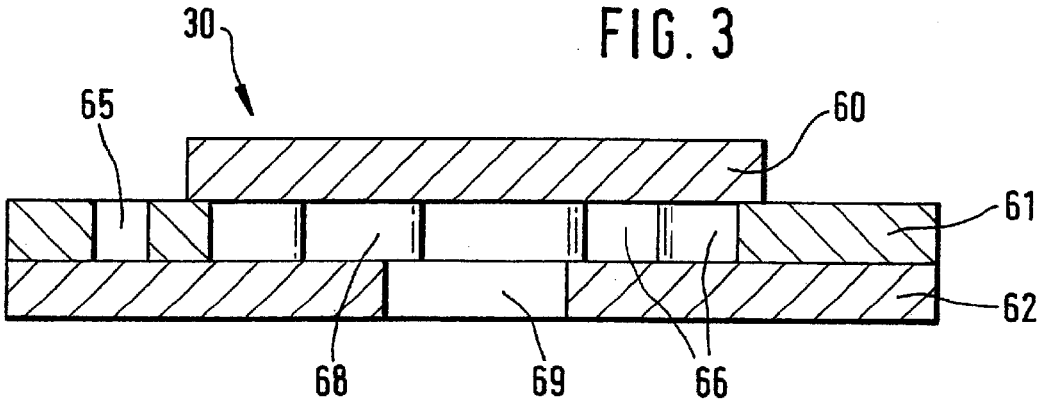
FIG. 3 depicts a cutaway view through the perforated disk along the line III—III in FIG. 2.

FIG. 2 depicts a perforated disk 30 in a top view, having three sheet-metal layers, whereas FIG. 3 depicts a cutaway view along line III—III in FIG. 2. Perforated disk 30 is composed, e.g., of three sheet-metal layers placed one on top of the other, which can be separated out from large sheet-metal foils in the manufacturing process for the perforated disks, as is known, e.g., from German Published Patent Application No. 197 24 075. The three layers, or disks, of perforated disk 30 are designated in the following in accordance with their function as cover layer 60, swirl-generating layer 61, and base layer 62. As can be derived from FIGS. 2 and 3, upper cover layer 60 is configured as having a smaller external diameter than both subsequent layers 61, 62. In this manner, it is assured that the fuel can flow past the cover layer 60 on the outside and thus can enter without hindrance into external intake areas 65 of, for example, eight swirl channels 66 in central swirl-generating layer 61. Perforated disks 30 of this type can also be produced having two, or more than three, layers.

Although cover layer 60 is executed as a simple metallic sheet-metal plate, in swirl-generating layer 61 a complex opening contour is provided, which runs over the entire axial thickness of this layer 61. The opening contour of central layer 61 is formed by an internal swirl chamber 68 and by a multiplicity of swirl channels 66 discharging into swirl chamber 68. Swirl channels 66 discharge, e.g., tangentially into swirl chamber 68. Whereas swirl chamber 68 is completely covered by cover layer 60, swirl channels 66 are only partially covered, because the external ends facing away from swirl chamber 68 constitute intake areas 65 that are open at the top. As a result of the tangential discharge of swirl channels 66 into swirl chamber 68, the fuel receives a rotational impulse, which is maintained even in a central circular outlet opening 69 of lower base layer 62. The diameter of outlet opening 69 is, for example, significantly smaller than the opening width of swirl chamber 68, which is situated directly above it. In this manner, the swirl intensity generated in swirl chamber 68 is enhanced. As a result of the centrifugal force, the fuel is spray-discharged in the shape of a hollow cone.

Figure 4:
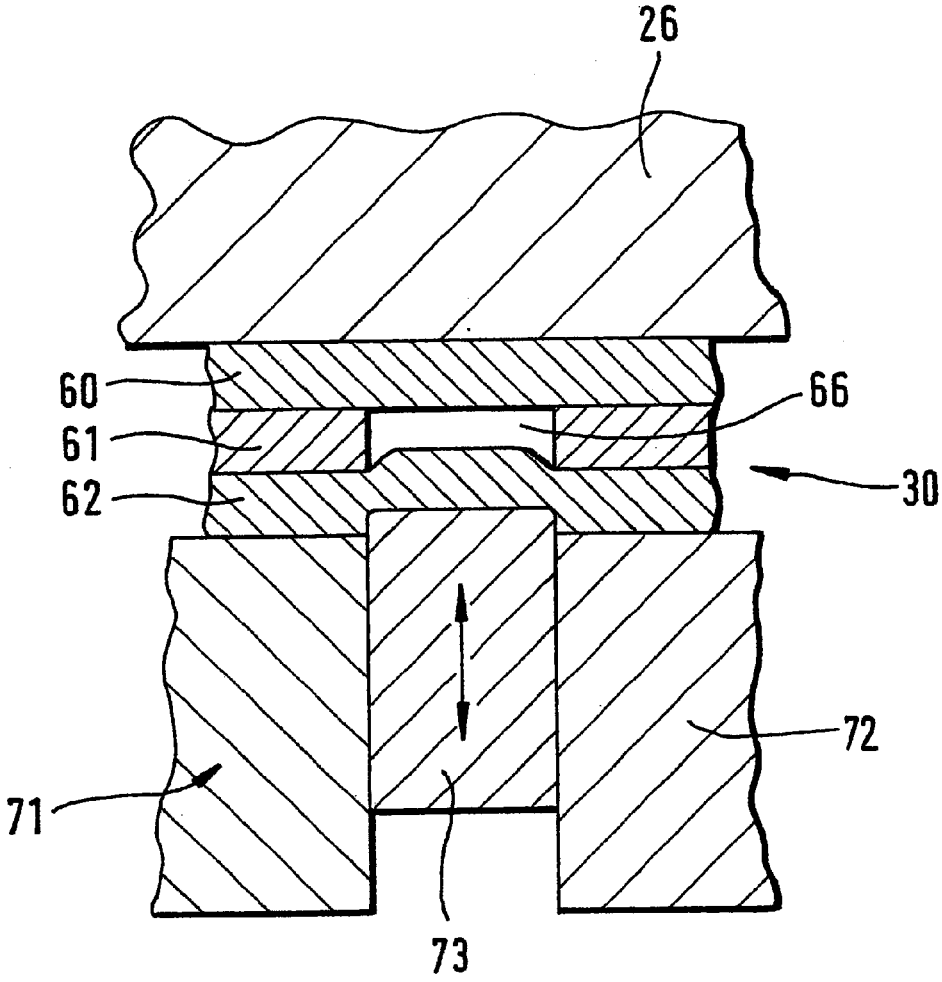
FIG. 4 depicts a schematic cutaway view in the area of a swirl channel of a perforated disk along with a deformation tool.

For the application of the method according to the present invention for adjusting the flow quantity of a perforated disk in a fuel injector, perforated disks other than perforated disk 30 depicted in FIGS. 2 and 3 are also suitable in the form of a swirl-atomizing disk. In FIG. 4, perforated disk 30 is schematically depicted in the area of a swirl channel 66, specifically in a cutaway plane, which runs perpendicular to the longitudinal extension of swirl channel 66. Contacting perforated disk 30 is a deformation tool 71, which includes, e.g., a stationary tool part as perforated disk receptacle 72 and at least one movable tool part in the form of a deformation ram 73. Perforated disk receptacle 72, together with valve seat element 26, assures a safe and reliable clamping of perforated disk 30 for any deformation of perforated disk 30. In addition to supporting perforated disk 30, stationary tool part 72 also takes on the task of guiding the at least one deformation ram 73. Ideally, deformation tool 71 is configured in a circular or annular fashion, such that, in accordance with the number of swirl channels 66, the same number of deformation rams 73 are provided, so that, if necessary, all swirl channels 66 can be changed in their cross-section at the same time.

After the assembly of the fuel injector, in particular of perforated disk 30 on the spray-discharge-side valve end, in a first method step of the method according to the present invention for adjusting the flow quantity, the fuel quantity per time unit of the opened fuel injector is measured, for example, using an undepicted measuring container arranged behind outlet opening 56. If the actual quantity discharged does not agree with the desired, predetermined setpoint quantity, then, in a second method step according to the present invention, deformation tool 71 is brought into contact with lower base layer 62 of perforated disk 30. Subsequently, at least one deformation ram 73 acts on base layer 62, as a result of which a deformation and a material shift of base layer 62 are carried out in the direction of an opening cross-section that is present within the perforated disk 30, in this case, of at least one swirl channel 66. In this manner, the opening cross-sections of one or a plurality of selected or of all swirl channels 66 of perforated disk 30 can be varied in a very simple manner and the flow quantities flowing through them can be adjusted. The deformation of base layer 62 proceeds until the actual quantity discharged corresponds to the predetermined setpoint quantity of the individual or of all swirl channels 66. In this context, the flow-through measurement can be carried out immediately during the deformation process. After the termination of the plastic deformation of base layer 62, deformation tool 71 is once again removed from perforated disk 30.

What is claimed is:

1. A method for adjusting a flow quantity in a fuel injector that includes an excitable actuation element, that includes a valve-closure member that can be moved axially along a longitudinal valve axis and that, for the purpose of opening and closing a valve, cooperates with a fixed valve seat configured on a valve seat element, and that includes one of a multilayer and multiple-disk, perforated disk arranged downstream of the valve seat, the method comprising the steps of:

measuring a discharged fuel quantity of the fuel injector when opened; and deforming a lower base layer of the perforated disk in a direction of the valve seat into a vacant flow-cross-section of a layer situated on top of the lower base layer, wherein, as a result, the vacant flow-cross-section within the perforated disk is changed until an actual quantity discharged corresponds to a predetermined setpoint quantity.

2. The method according to claim 1 wherein:

the perforated disk includes one of at least two metallic layers and at least two metallic disks.

3. The method according to claim 1 wherein:

the perforated disk includes three sheet-metal layers that are situated on top of each other.

4. The method according to claim 2 wherein:

the lower base layer includes a central outlet opening, and the layer situated directly above the lower base layer in an upstream direction is configured as a swirl-generating layer including at least one swirl channel.

5. The method according to claim 4 wherein:

a plurality of swirl channels is arranged over a periphery of the swirl-generating layer.

6. The method according to claim 4 wherein:

the deformation of the lower base layer takes place in an area of the at least one swirl channel, so that a material of the lower base layer is shifted into the vacant flow-cross-section of the at least one swirl channel.

7. The method according to claim 1 further comprising the step of:

performing a flow-through measurement of a fuel through the perforated disk during the step of deforming.

8. The method according to claim 1 wherein:

in order to deform the lower base layer, a deformation tool is used, the deformation tool including a stationary tool part as a perforated disk receptacle and at least one movable tool part in the form of a deformation ram.

9. The method according to claim 8 further comprising the step of:

operating a plurality of deformation rams in order to provide deformations of the lower base layer at different locations of the perforated disk simultaneously.

10. The method according to claim 5 further comprising the step of:

operating a plurality of deformation rams in order to change the vacant flow-cross-section of the plurality of swirl channels at the same time.

* * * * *